US008613513B2

(12) United States Patent
Ichinose

(10) Patent No.: US 8,613,513 B2
(45) Date of Patent: Dec. 24, 2013

(54) SHEET-MEDIUM CONVEYING APPARATUS AND IMAGE FORMING APPARATUS HAVING A CONVEYING BELT WITH A CHARGE PATTERN

(75) Inventor: Hiroki Ichinose, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 906 days.

(21) Appl. No.: 12/588,715

(22) Filed: Oct. 26, 2009

(65) Prior Publication Data

US 2010/0118097 A1 May 13, 2010

(30) Foreign Application Priority Data

Nov. 7, 2008 (JP) ..... 2008-286843

(51) Int. Cl.
*B41J 2/01* (2006.01)
*B65H 5/02* (2006.01)

(52) U.S. Cl.
USPC ..... 347/104; 271/275; 271/264

(58) Field of Classification Search
None
See application file for complete search history.

(56) References Cited

U.S. PATENT DOCUMENTS

| | | | | |
|---|---|---|---|---|
| 2007/0103532 | A1* | 5/2007 | Imoto et al. | 347/104 |
| 2008/0094459 | A1* | 4/2008 | Sakagami | 347/102 |
| 2009/0201530 | A1* | 8/2009 | Bustamante | 358/1.15 |

FOREIGN PATENT DOCUMENTS

| | | |
|---|---|---|
| JP | 3604894 | 10/2004 |
| JP | 2005-015227 | 1/2005 |
| JP | 2005-343167 | 12/2005 |
| JP | 3804928 | 5/2006 |
| JP | 2006-232462 | 9/2006 |
| JP | 2007-021918 | 2/2007 |
| JP | 2007-030316 | 2/2007 |
| JP | 2007-076266 | 3/2007 |
| JP | 2007-144790 | 6/2007 |

OTHER PUBLICATIONS

Abstract of JP 2003-103857 published on Apr. 9, 2003.
Abstract of JP 11-245389 published on Sep. 14, 1999.

* cited by examiner

*Primary Examiner* — Mark Robinson
*Assistant Examiner* — Andrew Jordan
(74) *Attorney, Agent, or Firm* — Harness, Dickey & Pierce P.L.C.

(57) ABSTRACT

A plus power unit and a minus power unit apply a positive voltage and a negative voltage, respectively, to respective charging rollers. A positively charged area and a negatively charged area each of which is equivalent to the width of a short roller in length in a direction vertical to a conveying direction are alternately formed on a surface of a conveying belt. It is ensured to adsorb a leading end and a trailing end of printing paper with a charge pitch width (the width of the positively charged area and the negatively charged area).

19 Claims, 15 Drawing Sheets

SHEET-MEDIUM CONVEYING APPARATUS AND IMAGE FORMING APPARATUS HAVING A CONVEYING BELT WITH A CHARGE PATTERN

CROSS-REFERENCE TO RELATED APPLICATIONS

The present application claims priority to and incorporates by reference the entire contents of Japanese Patent Application No. 2008-286843 filed in Japan on Nov. 7, 2008.

BACKGROUND OF THE INVENTION

1. Field of the Invention

The present invention relates to a sheet-medium conveying apparatus including a conveying belt that conveys a sheet-medium by electrostatic adsorption.

2. Description of the Related Art

An ink-jet recording apparatus that performs printing by depositing droplets of a recording liquid onto a sheet recording medium while conveying the sheet recording medium, by using a recording head, for example, which includes a liquid discharging head that discharges a droplet of a recording liquid, is known as an image forming apparatus, such as a printer, a facsimile apparatus, a photocopier, and a multi-function peripheral.

To achieve a high image quality, the precision of a spotting position of an ink droplet on a recording medium needs to be improved, and a structure of a recording head that jets an ink droplet and a recording medium need to be conveyed with high precision.

To improve the conveyance precision of a recording medium, proposed is an ink-jet recording apparatus of a so-called charged-belt type that is configured to convey a recording medium by adsorbing the recording medium electrostatically with a charged endless conveying belt, and revolving the conveying belt in the state that the recording medium is adsorbed.

First of all, an ink-jet recording apparatus of a conventional charged-belt type is explained below.

FIGS. 14 and 15 are a plan view and a side view, respectively, of a configuration of and around a conveying belt according to the ink-jet recording apparatus of the conventional charged-belt type.

The amount of revolution of a driving roller 12 that drives a conveying belt 11 is detected by an encoder 13 that is provided at an end of the driving roller 12; and then a control unit 14 drives a sub-scan motor 16 by controlling a driving unit 15 in accordance with the detected amount of revolution, and controls output of an alternating current (AC) power unit (AC bias supply unit) 18 for applying a high voltage (AC bias) onto a charging roller 17.

At that time, as the AC power unit 18 controls a cycle (application time) of an AC voltage to be applied onto the charging roller 17, and the control unit 14 controls driving of the conveying belt 11 at the same time, positive and negative charges can be applied onto the conveying belt 11 with a certain charge-cycle length. The "charge-cycle length" means a width (distance) in a conveying direction per cycle of an AC voltage to be supplied.

When starting printing, the conveying belt 11 is revolved clockwise in FIG. 15 by rotationally driving the driving roller 12 with the sub-scan motor 16, and at the same time, a square wave of which polarity alternates between positive and negative is applied onto the charging roller 17 from the AC power unit 18. Because the charging roller 17 is in contact with an insulating layer of the conveying belt 11, a positive charge and a negative charge are applied to the insulating layer of the conveying belt 11 alternately in a directional orthogonal to the conveying direction (sub-scan direction) of the conveying belt 11. As shown in FIG. 14, as a result, a positively charged area 101 and a negatively charged area 102 are formed alternately in belt-like stripe in regular width.

When the insulating layer of the conveying belt 11 has a volume resistivity of $10^{12}$ Ωcm or higher, preferably a volume resistivity of $10^{15}$ Ωcm, it is possible to prevent a positive charge and a negative charge from moving beyond a boundary, and keep positive and negative charges applied on the insulating layer.

Principles of charging are explained below with reference to FIG. 16.

When a charged dielectric is placed in an electric field, a Coulomb force (F=qE) is generated in a charge in the dielectric. The force is exerted on both a true charge and a polarized charge, so that a force received by the dielectric from the electric field is expressed with Maxwell stress tensor (the following Equations (1) to (4)).

$$F = \int (\rho + \rho_p) E dv = \int E \cdot (\varepsilon \cdot \mathrm{div} E) dv = \int T \cdot n ds \tag{1}$$

$$T = \varepsilon_0 \begin{pmatrix} E_x^2 - \frac{1}{2}E^2 & E_x E_y & E_x E_z \\ E_y E_x & E_y^2 - \frac{1}{2}E^2 & E_y E_z \\ E_z E_x & E_z E_y & E_z^2 - \frac{1}{2}E^2 \end{pmatrix} \tag{2}$$

$$n = \begin{pmatrix} n_x \\ n_y \\ n_z \end{pmatrix} \tag{3}$$

$$F = \begin{pmatrix} F_x \\ F_y \\ F_z \end{pmatrix} \tag{4}$$

In the above equations, ρ denotes a true charge per unit of volume (volume density of charge c/m$^3$), $\rho_p$ denotes a polarized charge per unit of volume (volume density of charge c/m$^3$), ∈ denotes the permittivity of the dielectric, and $\in_0$ denotes the permittivity in a vacuum.

A force acting on printing paper 19 shown a schematic diagram in FIG. 16 is obtained in two dimensions by using the above equations. Where it is assumed that a region of the printing paper 19 is denoted by S, an adsorption force acting on the paper is denoted by Fy, and influence in the thickness direction of the printing paper 19 is ignored; the surface vector of a boundary surface S1 between the printing paper 19 and the conveying belt 11 (vertical to the surface and outward) can be expressed by n1=(0, −1.0). Accordingly, the following Equation (5) is obtained.

$$\begin{aligned} Fy &= \int \left\{ \varepsilon_0 \cdot \left( Ey \cdot Ex,\ Ey^2 - \frac{1}{2}E^2,\ Ey \cdot Ez \right) \cdot (0, -1, 0) \right\} ds \\ &= \int \varepsilon_0 \cdot \left( -Ey^2 + \frac{1}{2}E^2 \right) ds \end{aligned} \tag{5}$$

Because the above equation is two-dimensional, when Ez=0, the following Equation (6) is obtained:

$$E^2 = Ex^2 + Ey^2 + Ez^2 = Ex^2 + Ey^2 \tag{6}$$

The following Equation (7) is obtained by substituting Equation (6) into Equation (5):

$$Fy_{(S1)} = \int \varepsilon_0 \cdot \left(\frac{1}{2}Ex^2 - \frac{1}{2}Ey^2\right) ds \tag{7}$$

From Equation (7) it is clear that, when Ex<Ey, the adsorption force is large.

Similarly, the surface vector of a printing surface S2 is (0, 1.0), accordingly, the following Equation (8) is obtained:

$$\begin{aligned} Fy &= \int \left\{\varepsilon_0 \cdot \left(Ey \cdot Ex,\ Ey^2 - \frac{1}{2}E^2,\ Ey \cdot Ez\right) \cdot (0, 1, 0)\right\} ds \\ &= \int \varepsilon_0 \cdot \left(Ey^2 - \frac{1}{2}E^2\right) ds \end{aligned} \tag{8}$$

Accordingly, when Ez=0, the following Equation (9) is obtained:

$$Fy_{(S2)} = \int \varepsilon_0 \cdot \left(-\frac{1}{2}Ex^2 + \frac{1}{2}Ey^2\right) ds \tag{9}$$

From Equation (9) it is clear that, when Ex<Ey, the adsorption force is large.

From the above discussion, to obtain an adsorption force, it is found that an electric field vertical to the paper is required on the boundary surface S1 between the conveying belt 11 and the printing paper 19, and an electric field horizontal to the paper is required on the printing surface S2. In other words, even if forming an electric field that is uniform in the vertical direction of paper, an adsorption force is not generated, so that an adsorption force needs to be maintained by forming an electric field as described above while forming a non-uniform electric field.

When applying positive and negative charges alternately on the conveying belt 11, as shown in FIG. 17, lines of electric force are not generated to be uniform only in one direction, so that the electric field is not to be uniform. This corresponds to the non-uniform electric field described above.

When the printing paper 19 is charged under a state where an electric field as described above is formed in this way, internal polarization arises in the printing paper 19. Moreover, because the printing paper 19 is not an insulator, a true charge also moves in accordance with the electric field. However, the electric field is not uniform, a charge moves biasedly along the lines of electric force. For example, with respect to the negatively charged area 102 shown in the center of the figure in which the conveying belt 11 is negatively charged, a positive charge appears on the boundary surface between the printing paper 19 and the conveying belt 11. However, on the surface side (printing surface) of the printing paper 19, the electric field is dense in the vicinity of a boundary surface between a positive polarity and a negative polarity of the conveying belt 11, on the contrary, it is sparse in the center, so that a charge appears only in a part where the electric field is dense.

In this way, differences are brought about because conditions of generation of a charge vary between the front side and the back side of the printing paper 19, consequently, a downward adsorption force is generated as explained above with reference to FIG. 16.

To make it clearly understandable, the strengths of the electric field are indicated by arrows in FIG. 18. As is clear from the figure, on the boundary surface S1 between the conveying belt 11 and the printing paper 19, the strength of the electric field in the vertical direction is high in the vicinity of each boundary surface between a positive polarity and a negative polarity of the conveying belt 11. For this reason, on the contrary, the strength is low in the center part where each charge area is stable. Also on the front side (printing surface) S2 of the printing paper 19, the strength of the electric field in the horizontal direction is the highest in the vicinity of each boundary surface between a positive polarity and a negative polarity of the conveying belt 11. Similarly, the strength is low in the center part of the conveying belt 11. In other words, because the electric field required for adsorption is the greatest in the vicinity of each boundary part between a positive polarity and a negative polarity of the conveying belt 11, it is clear that an adsorption force in the part is the strongest.

Returning to explanation of FIGS. 14 and 15.

The printing paper 19 is sent to the conveying belt 11 on which a non-uniform electric field is generated by forming positive and negative charges on the conveying belt 11. The printing paper 19 is conveyed in a state that the printing paper 19 is pressed onto the conveying belt 11 by pressure rollers 21.

Inside the printing paper 19 sent onto the non-uniform electric field on the conveying belt 11, movement of a charge occurs along a direction of the electric field. Precisely, the electric field toward a recording head (not shown) provided under ink cartridges 20 is reduced. Moreover, a charge applied on the surface of the conveying belt 11 and a charge that has an electric repulsion against the charge on the conveying belt 11 are reduced on the surface of the printing paper 19, consequently, an adsorption force of the printing paper 19 to the conveying belt 11 increases with time.

FIG. 19 is a graph of a temporal transition of adsorbability with respect to humidity as a parameter until a certain adsorption force is generated. According to the graph, it is clear that an adsorption force is a function of time. In other words, the graph indicates that it takes a long time to move a charge inside the printing paper 19. Moreover, it is found that movement of a charge takes a long time when the value of resistance of the printing paper 19 is high, because the value of resistance of paper is generally low in high humidity, by contrast, it is generally high in low humidity. For this reason, when the value of resistance is high, and a conveying speed is high, an adsorption force is insufficient, so that a strong electric field needs to be formed by increasing a voltage, as a result, charge irregularity tends to occur (the reason for this will be described later with reference to FIG. 20).

As described above, the printing paper 19 adsorbed onto the conveying belt 11 is conveyed to a position below the recording head, and then an image corresponding to one reciprocation of the head is formed on the printing paper 19 as the ink cartridges 20 is reciprocated in the main-scan direction, and at the same time ink droplets are discharged by the recording head. When an image corresponding to one reciprocation is formed, the printing paper 19 is sent to the next printing position by the conveying belt 11, and then image formation corresponding to one reciprocation is carried out.

When a leading end of the printing paper 19 reaches the position of driven spurs 22, the printing paper 19 is held by the pressure rollers 21, the conveying belt 11, and the driven spurs 22. When printing a trailing end of the printing paper 19, the printing paper 19 goes out from the pressure rollers 21 first, and the printing paper 19 is held by the driven spurs 22 and the conveying belt 11. When printing operations equivalent to one sheet are finished, the printing paper 19 is conveyed as it is by the conveying belt 11, and delivered.

However, as shown in FIG. 18, because the adsorption force becomes the largest at the boundary between a positive polarity and a negative polarity, and the smallest at the center of each of a positive polarity and a negative polarity, the adsorption force at the leading end of paper and that at the trailing end of the paper are lower except when the boundary between a positive polarity and a negative polarity is at the leading end or the trailing end. Although a holding force can be maintained by enhancing a charge (specifically, an applied charge is increased), the electric field becomes strong, resulting in influence on discharge of ink in a printing area in some cases.

Such situation is explained below with reference to FIGS. 20A and 20B. FIG. 20A depicts a condition of spotting when discharging ink at regular intervals without influence of an electric field, and FIG. 20B depicts a condition of spotting when discharging ink at regular intervals under a state where an electric field is formed.

Although it is empirically found that a discharged ink droplet (particularly, in a case of a small droplet, which is easily influenced) tends to have a negative charge); if there is no influence of any electric field, ink droplets 104 that is discharged spots at a desired position on the printing paper 19 as shown in FIG. 20A. However, if an electric field is formed, as shown in FIG. 20B, the ink droplets 104 that have a negative charge are influenced by the electric field on printing paper, and spotting positions are deviated, thereby causing image abnormality called charge irregularity. The charge irregularity is remarkable when the value of resistance of the printing paper 19 is high and the ink droplets 104 are small under a particularly strong electric field.

As a measure other than increasing the applied voltage, a method of controlling so as to align the leading end and the trailing end of the printing paper 19 with a charge boundary surface is conceivable; however, such method is restricted by the length of the printing paper 19 and the charge-cycle length, therefore, when one of the leading end and the trailing end is aligned with the charge boundary surface, the other may miss timing.

The problems described above can be summarized in the following paragraphs (1) and (2).

(1) In the conventional charged-belt method, the leading end and the trailing end of printing paper in the conveying direction have one of a positive polarity and a negative polarity. Because an adsorption force acts most strongly at the boundary between a positive polarity and a negative polarity, there is a problem that the adsorption force is consequently weaker at the leading end and the trailing end.

(2) Because the amount of charge varies depending on electric characteristics of the printing paper and environmental variations, an adsorption force changes. Although application of a strong electric field can be conceivable in order to accept change in the adsorption force, the electric field influences characteristics of discharging ink, thereby causing an abnormal image in stripe, which is called a nonuniform-charge image, or staining the printing head with mist generated when discharging ink, and consequently causing an abnormal image, such as a discharge fault or a frictional image.

SUMMARY OF THE INVENTION

It is an object of the present invention to at least partially solve the problems in the conventional technology.

According to an aspect of the present invention, there is provided a sheet-medium conveying apparatus including a conveying belt configured to adsorb a sheet medium with an electrostatic force by being electrically charged and convey the sheet medium; and a charge-pattern forming unit configured to form a certain charge pattern on the conveying belt, wherein at least on positions to which a leading end and a trailing end of the sheet medium are to be adsorbed, the charge-pattern forming unit forms a charge pattern in which a polarity changes in a direction orthogonal to a conveying direction of the conveying belt.

According to another aspect of the present invention, there is provided an image forming apparatus including the above sheet-medium conveying apparatus; and a recording head that forms an image on a sheet medium conveyed by the sheet-medium conveying apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below with reference to the accompanying drawings.

Figure 1:
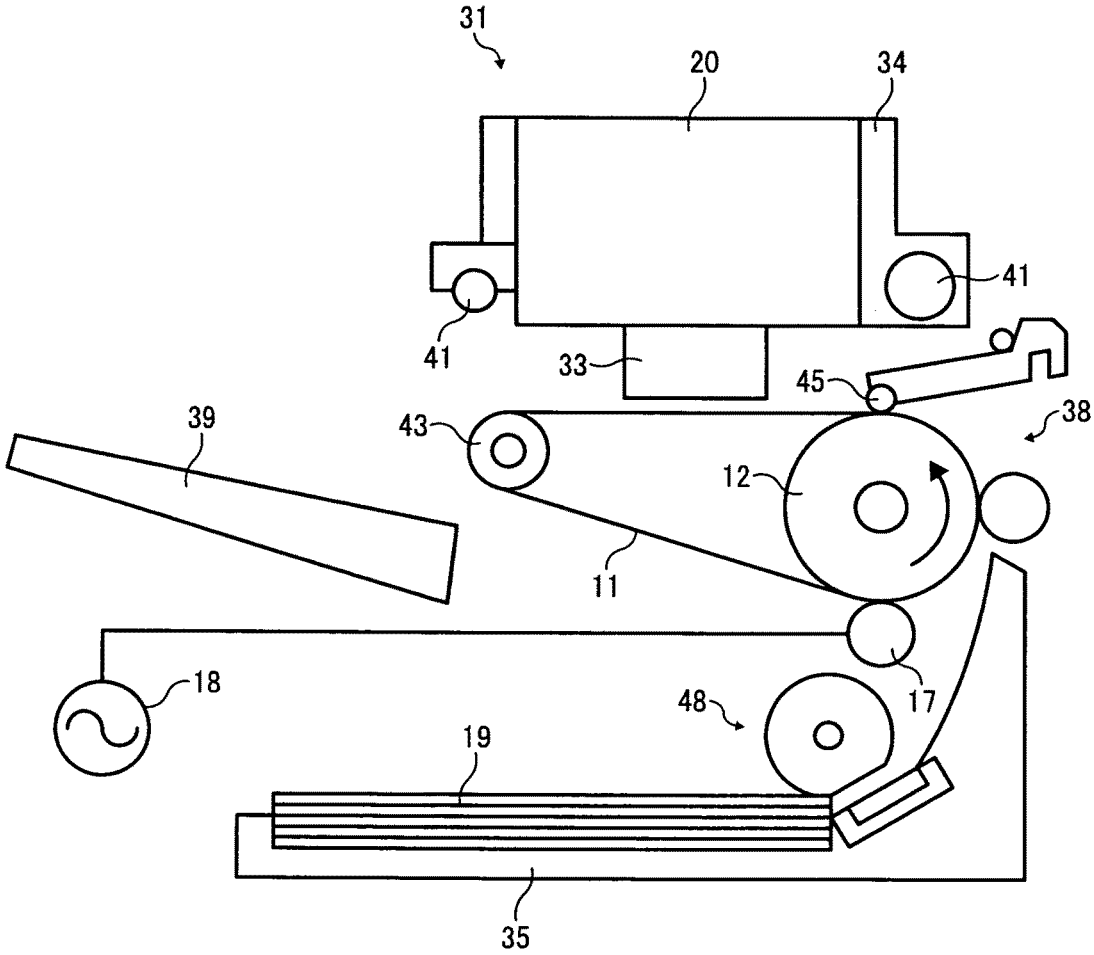
FIG. 1 is a schematic diagram of a configuration of relevant parts of an image forming apparatus according to a first embodiment of the present invention.

FIG. 1 is a schematic diagram of a configuration of relevant parts of an image forming apparatus 31 according to a first embodiment of the present invention. The image forming apparatus 31 is a serial-type ink-jet recording apparatus. The same parts or corresponding parts in the figure with those of the conventional apparatus (FIGS. 14 and 15) are assigned with the same reference numerals as those in FIGS. 14 and 15.

The image forming apparatus 31 includes four ink cartridges 20 each of which accommodates respective color toner, namely, cyan C, magenta M, yellow Y, and black K; a plurality of nozzle rows; a recording head 33 to which ink is supplied from each of the ink cartridges 20; a carriage 34 on which the ink cartridges 20 and the recording head 33 are installed; a paper conveying device 38 that conveys printing paper 19 from a paper feeding tray 35 that accommodates the printing paper 19 to a printing section (a position opposite to the recording head 33); and a paper delivery tray 39 that accommodates the printing paper 19 that is printed.

The paper conveying device 38 includes the conveying belt 11 that is strained around the driving roller 12 and a driven roller 43 and can reciprocate; a pressing roller 45 that is pressed onto the conveying belt 11 on the driving roller 12 with elasticity of an elastic member, such as a spring, in order to avoid a slip between the driving roller 12 and the conveying belt 11; and the charging roller 17 that is provided in contact with the conveying belt 11 and opposite to the driving roller 12 at a position upstream in the rotational direction of the driving roller 12 from a position to be in contact with the conveying belt 11 that is strained around the driving roller 12, and onto which the printing paper 19 loaded on the paper feeding tray 35 is sent by being separated by a separating unit 48. The charging roller 17 is applied with a charge for forming a certain charge pattern on the conveying belt 11 from the power unit 18.

When printing onto the printing paper 19 image data sent from a host device, which will described later, a character or an image is recorded by jetting ink droplets in accordance with the image data from a nozzle of the recording head 33 onto the printing paper 19 sent to a printing section by the paper conveying device 38 while sweeping the carriage 34 along a carriage guide roller 41.

During the printing, the conveying belt 11 is revolved anticlockwise by rotating the driving roller 12 of the paper conveying device 38 with a not-shown driving motor, and at the same time, a certain voltage is applied to the charging roller 17 from the power unit 18. The conveying belt 11 is charged with the voltage applied to the charging roller 17. When the conveying belt 11 comes into contact with the printing paper 19 an electrostatic force acts on the printing paper 19 whereby the printing paper 19 is adsorbed onto the conveying belt 11.

Figure 2:
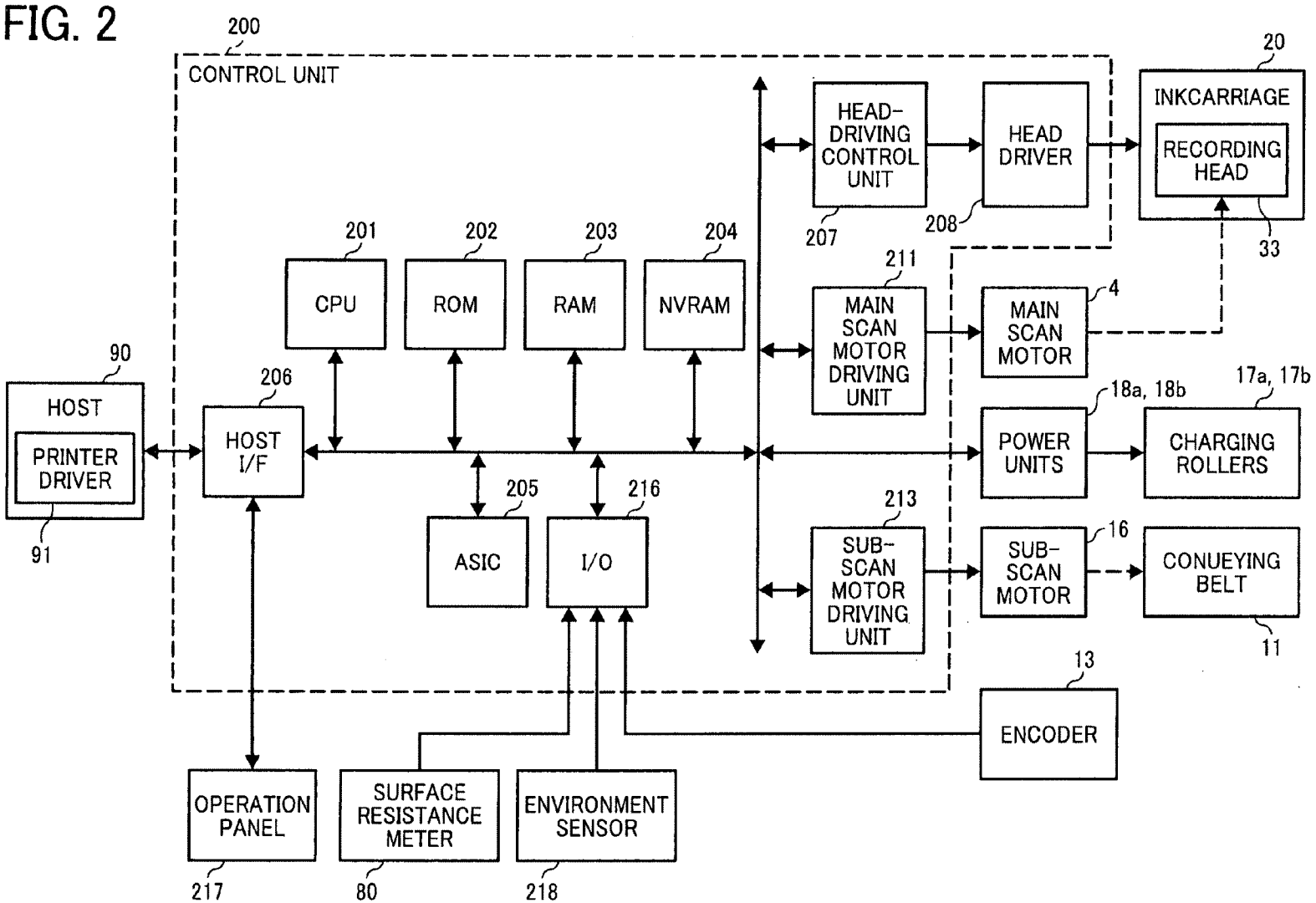
FIG. 2 is a functional block diagram of a configuration of a control unit of the image forming apparatus shown in FIG. 1.

FIG. 2 is a functional block diagram of a configuration of a control unit 200 of the image forming apparatus 31. The control unit 200 includes a central processing unit (CPU) 201; a read-only memory (ROM) 202 that stores therein a computer program to be executed by the CPU 201 and other fixed data; a random access memory (RAM) 203 that temporarily stores therein image data and other data; a nonvolatile rewritable memory (NVRAM) 204 that saves data even while the power of the apparatus is shut down; an application specific integrated circuit (ASIC) 205 that performs various signal processing on image data, image processing of sorting, and other input-output signal processing for controlling the entire apparatus.

Moreover, the control unit 200 includes a host interface (I/F) 206 for transmitting and receiving data and signals from and to a host 90 that is a data processing device, such as a personal computer; a head-driving control unit 207 and a head driver 208 for driving and controlling the recording head 33; a main-scan motor driving unit 211 for driving a main-scan motor 4; a sub-scan motor driving unit 213 for driving the sub-scan motor 16; the encoder 13; an environment sensor 218 that detects surrounding temperature and humidity; a surface resistance meter 80 that detects a surface resistance of printing paper; and an input/output (I/O) 216 for receiving input of a detection signal from the encoder 13 and other various sensors.

Furthermore, the control unit 200 is connected to an operation panel 217 that receives input of information required for the apparatus, and displays information. Moreover, the control unit 200 controls ON/OFF of output of the power unit 18 that applies a voltage to the charging rollers 17 (17*a* and 17*b*).

The control unit 200 receives printing data including image data and other data from the side of the host 90 with the host I/F 206 via a cable or a network.

The CPU 201 then reads and analyzes printing data in a reception buffer included in the host I/F 206, and the ASIC 205 performs sorting processing or other processing on data, and transfers image data to the head-driving control unit 207. Conversion of printing data to bitmap data for image output is executed by a printer driver 91 on the side of the host 90; however, it can be performed by storing font data into, for example, the ROM 202.

When receiving image data (dot pattern data) equivalent to one line of the recording head 33, the head-driving control unit 207 sends the dot pattern data of one line as serial data to the head driver 208 in a synchronized manner with a clock signal, and sends a latch signal to the head driver 208 in certain timing.

The head-driving control unit 207 includes a ROM (it can be the ROM 202) that stores therein pattern data of a driving waveform (a driving signal), and a driving-waveform generating circuit that includes an amplifier and a waveform creating circuit including a digital-to-analog (D/A) converter that converts data of a driving waveform read from the ROM into analog data.

The head driver 208 includes a shift register that receives input of a clock signal from the head-driving control unit 207 and serial data that is image data; a latch circuit that latches a hold value of the shift register with a latch signal from the head-driving control unit 207; a level converting circuit (level shifter) that changes a level of an output value of the latch circuit; and an analog switch array (switching unit) of which ON/OFF is controlled by the level shifter. The head driver 208 selectively applies a required driving waveform included in a waveform to an actuator unit of the recording head 33 by controlling ON/OFF of the analog switch array, and drives the head.

The main-scan motor driving unit 211 calculates a control value based on a target value given from the side of the CPU 201 and a detected speed obtained by sampling a detected pulse from the encoder 13, and drives the main-scan motor 4 via a motor driver inside it. Similarly, the sub-scan motor driving unit 213 calculates a control value based on a target value given from the side of the CPU 201 and a detected speed obtained by sampling a detected speed obtained by sampling a detected pulse from the encoder 13, and drives the sub-scan motor 16 via a motor driver inside it.

Figure 3:
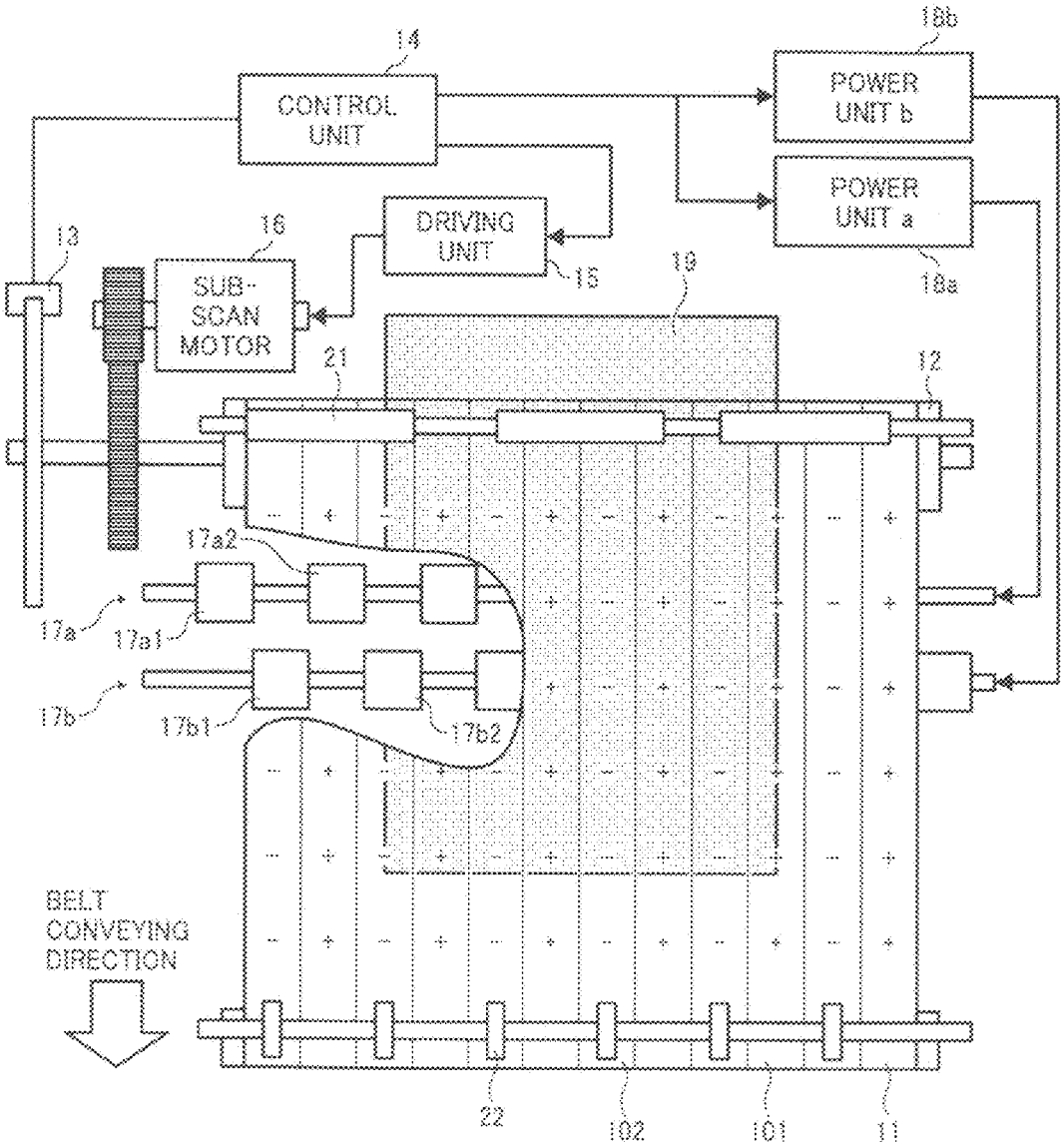
FIG. 3 is a plan view of a configuration of and around a conveying belt shown in FIG. 1.
Figure 14:
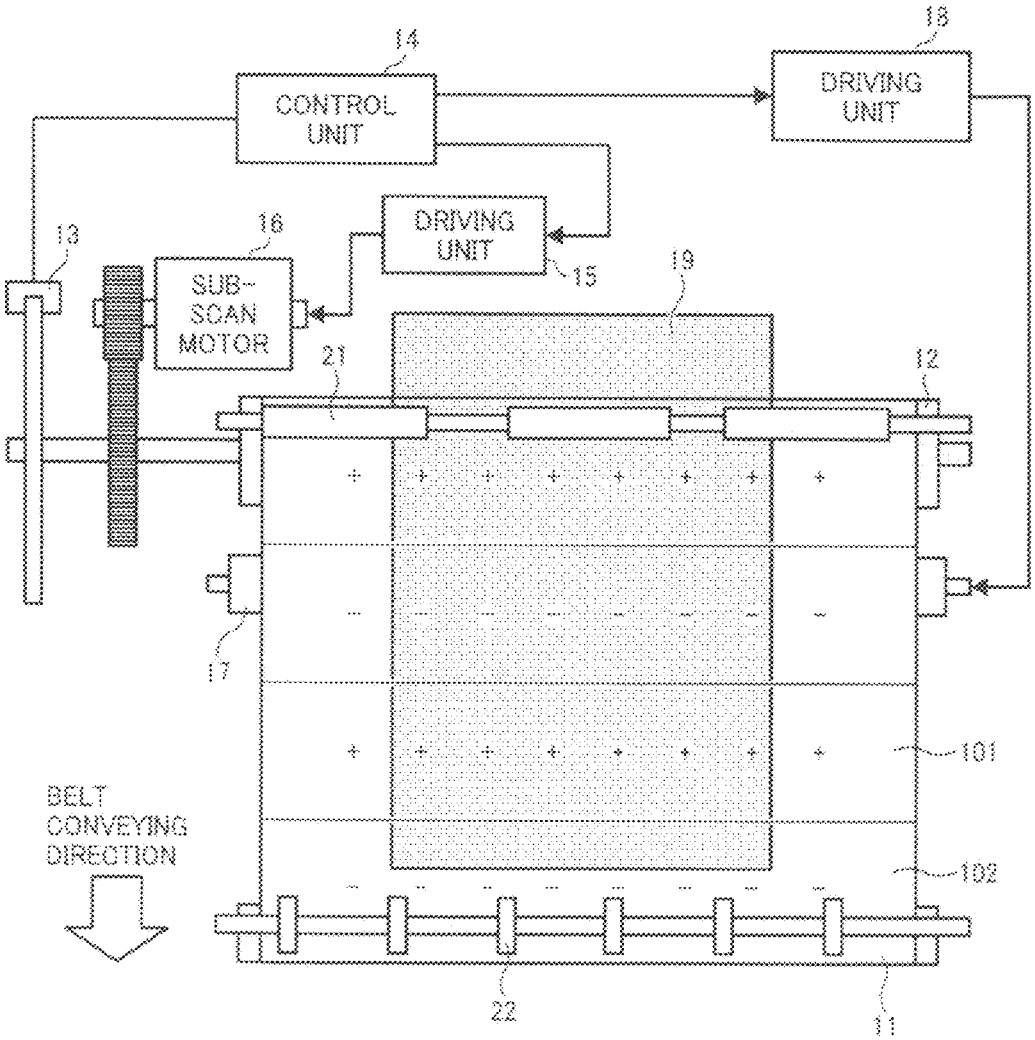
FIG. 14 is a plan view of a configuration of and around a conveying belt according to an ink-jet recording apparatus of a conventional charged-belt type.
Figure 15:
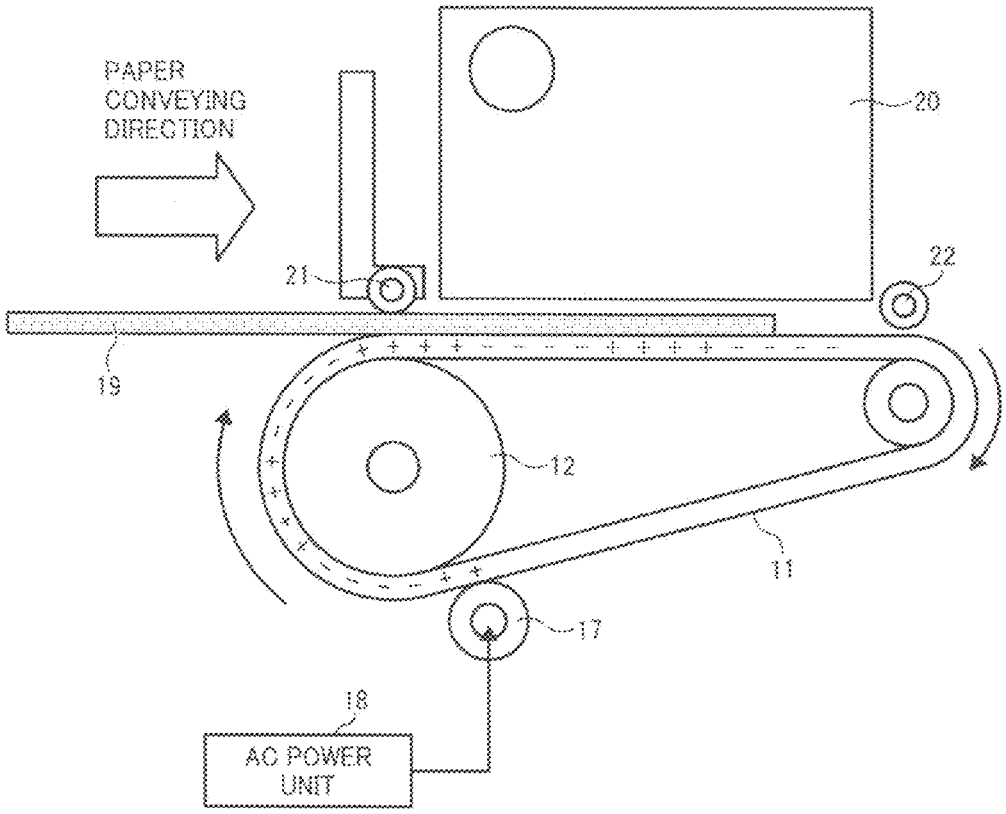
FIG. 15 is a side view of a configuration of and around the conveying belt according to the ink-jet recording apparatus of the conventional charged-belt type.

FIG. 3 is a plan view of a configuration of and around the conveying belt 11 shown in FIG. 1. The same parts or corresponding parts in the figure with those in FIG. 14 are assigned with the same reference numerals as those in FIG. 14. A side view of the conveying belt 11 is similar to FIG. 15 except charging rollers and power units, therefore it is omitted. The control unit 14 and the driving unit 15 in FIG. 3 correspond to the control unit 200 in FIG. 2.

Conventionally, an electric field is formed in a direction parallel to the conveying direction of the conveying belt 11. However, in the first embodiment, a configuration adopted such that a holding force in the conveying direction of the printing paper 19 is enhanced by forming an electric field in a direction vertical to the conveying direction of the conveying belt 11 (the conveying direction of the printing paper 19). As a result, floating of a leading end and a trailing end is reduced.

The charging roller 17 includes two rollers, namely, charging rollers 17*a* and 17*b*, which are arranged parallel to the conveying direction of the conveying belt 11. The charging rollers 17*a* and 17*b* are not long roller longer than the width of the conveying belt 11 (a dimension in the direction vertical to the conveying direction) as the conventional roller is. The charging rollers 17*a* and 17*b* include short rollers 17*a*1, 17*a*2, . . . , 17*b*1, 17*b*2, . . . , which are each narrow in width, and form a comb shape as arranged at regular intervals in the rotational axis direction. The charging rollers 17*a* and 17*b* are set so as to stagger the short rollers 17*a*1, 17*a*2, . . . of the charging roller 17*a* and the short rollers 17*b*1, 17*b*2, . . . of the charging roller 17*b* in the rotational axis direction.

The positively charged area 101, of which length in the direction vertical to the conveying direction is equivalent to the width of each of the short rollers 17*a*1, 17*a*2, . . . , and the negatively charged area 102, of which length in the direction vertical to the conveying direction is equivalent to the width of each of the short rollers 17*b*1, 17*b*2, . . . , are alternately and repeatedly formed on the surface of the conveying belt 11, by applying positive and negative voltages to the charging rollers 17*a* and 17*b* from a plus power unit (power unit a) 18*a* and a minus power unit (power unit b) 18*b*, respectively. The positively charged areas 101 and the negatively charged areas 102 are continuously formed in the conveying direction of the conveying belt 11.

Figure 16:
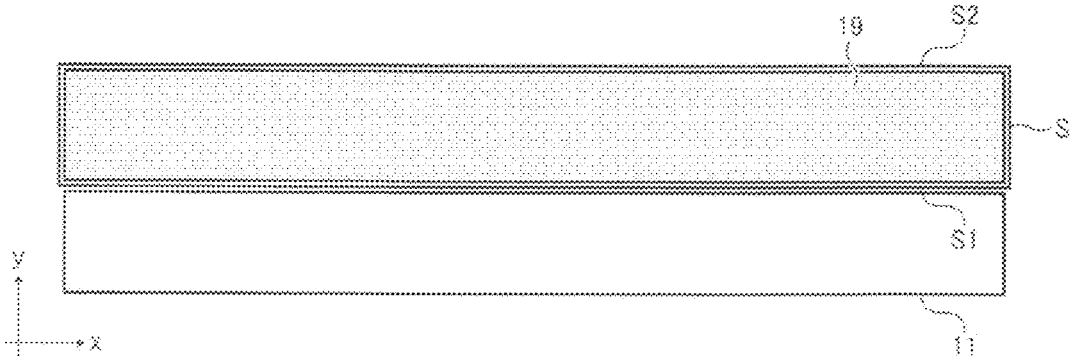
FIG. 16 is a schematic diagram for explaining charging principles.
Figure 17:
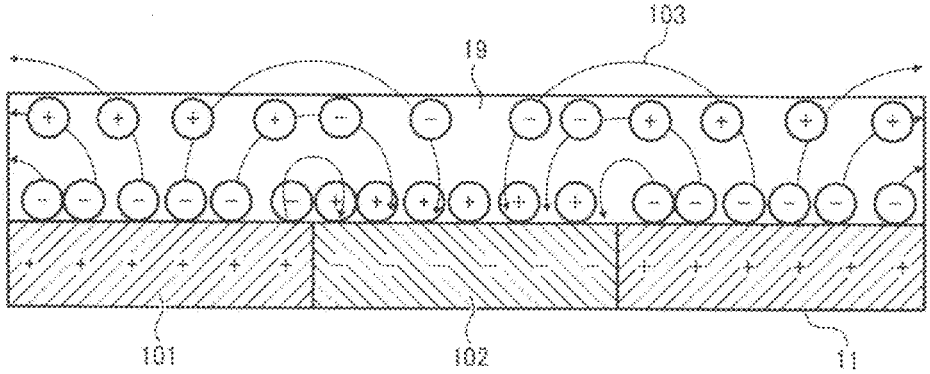
FIG. 17 is a schematic diagram of lines of electric force that are generated when alternately applying positive and negative charges on the conveying belt.
Figure 18:
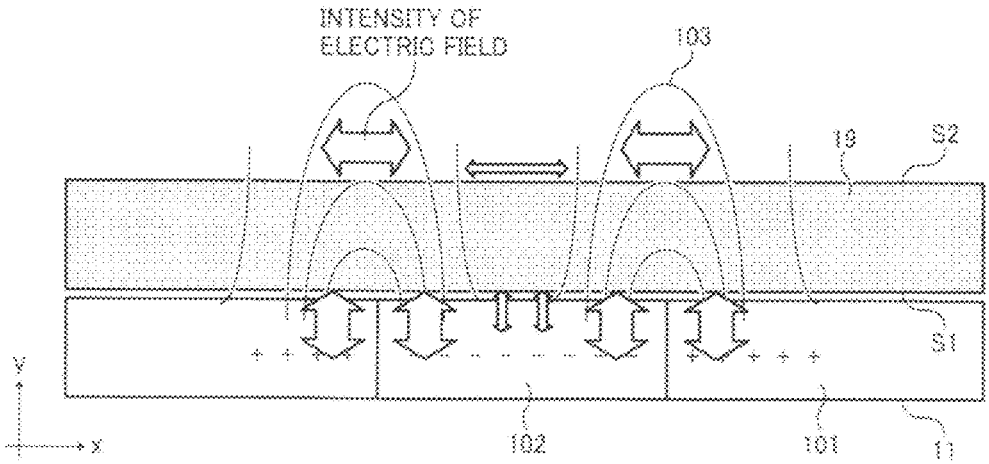
FIG. 18 is a schematic diagram that depicts an intensity of an electric field in FIG. 16 with arrows.

By forming such charge pattern, an electric field is formed in the direction vertical to the conveying direction of the printing paper 19. As explained above with reference to FIGS. 16 to 18, when an electric field in the vertical direction is formed on the back side of the printing paper 19, and an electric field in the horizontal direction is formed on the front side of the printing paper 19, the adsorption force can be maintained. Accordingly, if the charging direction of a charge is changed as described in the first embodiment, the adsorption force toward the conveying belt 11 does not change. Moreover, because a charge pattern in which the charge polarity alternates in the direction orthogonal to the conveying direction of the conveying belt 11 is formed continuously in the conveying direction, it does not need to match timings of the leading end and the trailing end as described above. In other words, because the leading end and the trailing end of the printing paper 19 can be securely adsorbed at intervals of the width of the charge pitch (each width of the positive and the negative charge areas), it is clear that the first embodiment is more advantageous than the conventional apparatus.

The adsorption force on the lateral edge sections of the printing paper 19 is weak, but it is in the paper conveying direction, so that the lateral edge sections does not have bounce at the time of adsorption and the time of removal to and from the conveying belt 11, thereby barely floating compared with the leading end and the trailing end. Furthermore, if the leading end and the trailing end are positioned by driven spurs, floating does not occur on the lateral edge sections, therefore the first embodiment is not inferior to the conventional apparatus.

Two of the charging rollers 17*a* and 17*b* are provided as described above, three or more charging rollers can be provided. In a case of three or more charging rollers, short rollers of the respective charging rollers are cyclically arranged not to overlap their positions one another in the rotational axis direction, consequently, the more number of charging rollers, the longer intervals of the short rollers are set in each charging roller, and the fewer number of short rollers are included in one charging roller. For example, when the charging rollers are three, to form the same charge patter as that in FIG. 2, the number of short rollers per charging roller is approximately two third. The respective power units are configured to apply voltages of opposite polarity to adjacent charging rollers.

Moreover, according to the first embodiment, although each of the short rollers 17*a*1, 17*a*2, . . . , 17*b*1, 17*b*2, . . . in the charging rollers 17*a* and 17*b* has the same width, it does not necessarily have the same width as long as the whole of the conveying belt 11 is charged positively and negatively alternately in its width direction by all of the short rollers.

Figure 4:
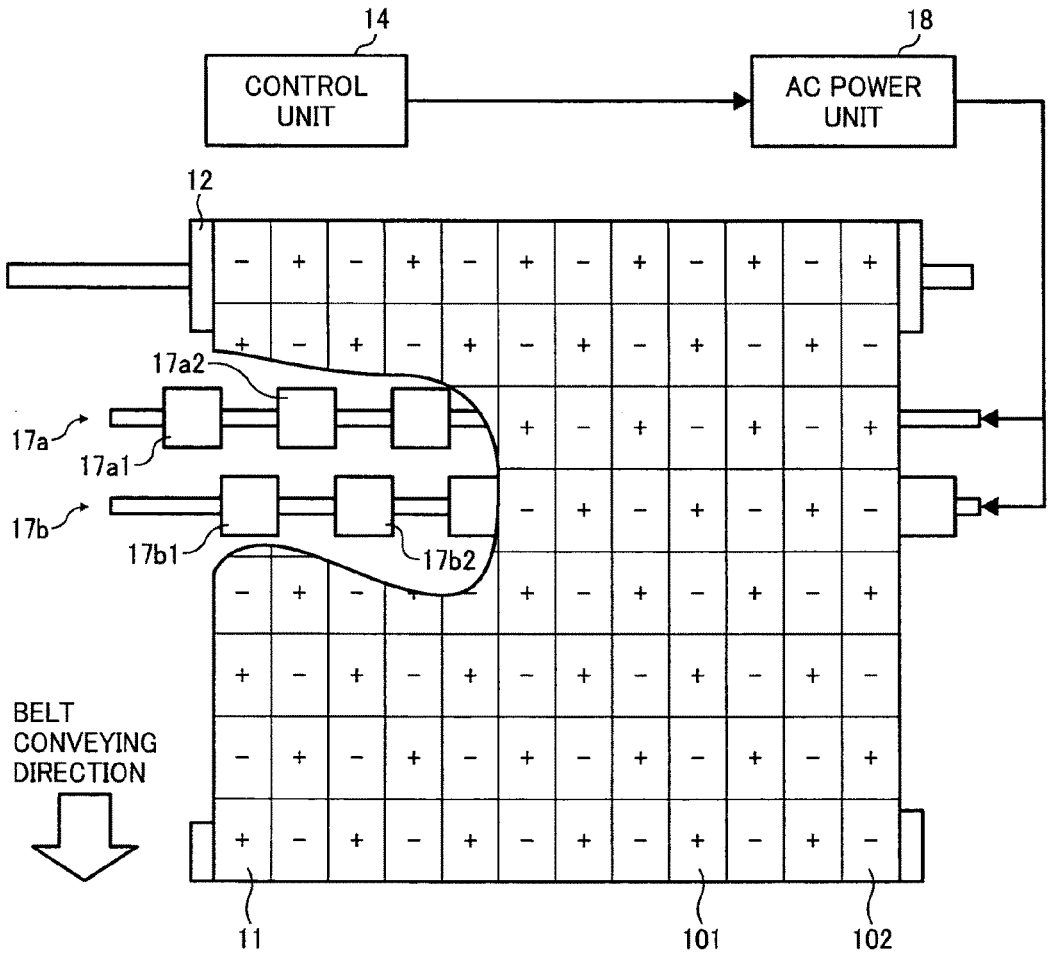
FIG. 4 is a plan view of a configuration of and around a conveying belt in an image forming apparatus according to a second embodiment of the present invention.

FIG. 4 is a plan view of a configuration of and around the conveying belt 11 in an image forming apparatus according to a second embodiment of the present invention. The same parts or corresponding parts in the figure with those in FIG. 3 are assigned with the same reference numerals as those in FIG. 3. Moreover, a configuration of relevant parts of the image forming apparatus according to the second embodiment and a configuration of a control unit are the same as those according to the first embodiment (FIGS. 1 and 2).

According to the first embodiment (FIG. 3), the plus power unit 18*a* and the minus power unit 18*b* are separately provided, and individually apply voltages to the conveying belt 11, resulting in a high cost. To take care of this issue, the second embodiment adopts a configuration to apply positive and negative voltages alternately to the two of the charging rollers 17*a* and 17*b* with a single alternating current (AC) power unit 18.

Thus, positive and negative voltages are alternately applied by the AC power unit 18 to the charging rollers 17*a* and 17*b* that are staggered in the paper conveying direction, so that a checkered charge pattern is formed on the conveying belt 11 with the positively charged areas 101 and the negatively charged areas 102. The charge pattern of each pair of the positively charged area 101 and the negatively charged area 102 can be considered as a staggered pattern.

Figure 20A:
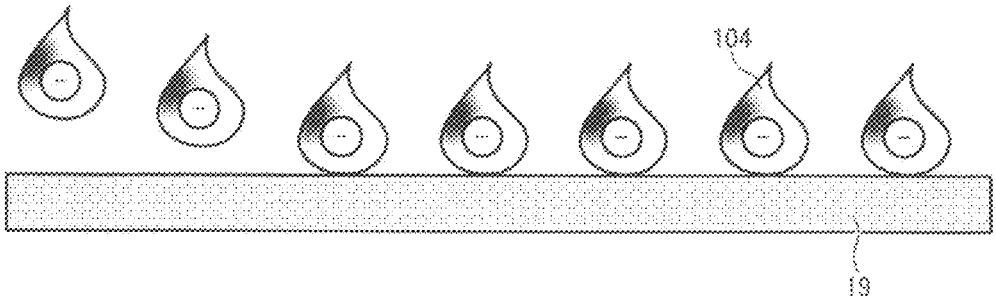
FIGS. 20A and 20B are schematic diagrams that depict a condition of spotting when discharging ink at regular intervals under a state without influence of electric field, and a condition of spotting when discharging ink at regular intervals under a state where an electric field is formed.
Figure 20B:
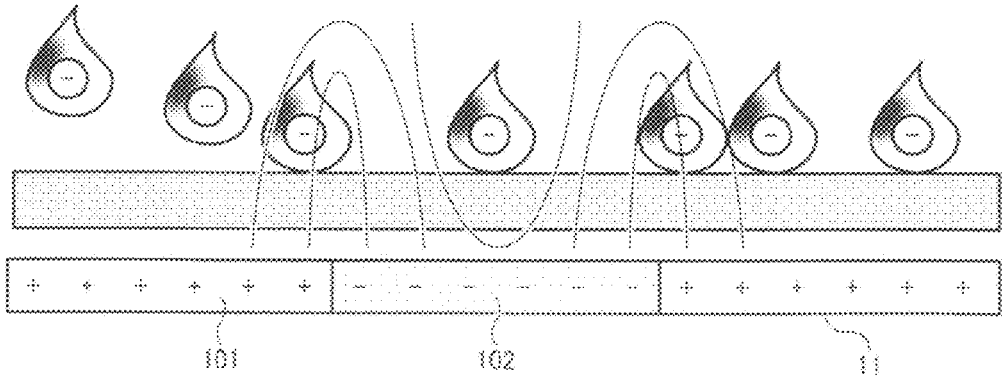

When such a charge pattern is formed, electric fields are formed in the vertical direction and the horizontal direction with respect to the conveying direction of the printing paper 19. As a result, the number of boundaries between positive and negative charge areas is increased and becomes more than those in the charge pattern in FIG. 3 so that the adsorption force is increased. Accordingly, a sufficient adsorption force can be obtained at the lateral edge section in addition to the leading end and the trailing end, so that paper can be conveyed more stably. Moreover, as the adsorption force is increased, an applied voltage can be reduced correspondingly; accordingly, occurrence of a side effect, such as influence on discharge of ink as explained with reference to FIG. 20, can be suppressed.

A configuration of relevant parts of an image forming apparatus according to a third embodiment of the present invention and a configuration of a control unit are the same as those according to the first embodiment (FIGS. 1 and 2). A plan view of a configuration of and around the conveying belt 11 is the same as that according to the first embodiment. The power unit 18*a* and the power unit 18*b* in the first embodiment output a positive direct-current voltage and a negative direct-current voltage. In contrast, in the third embodiment, the power unit 18*a* (power unit a) and the power unit 18*b* (power unit b) output an AC voltage.

Figure 5:
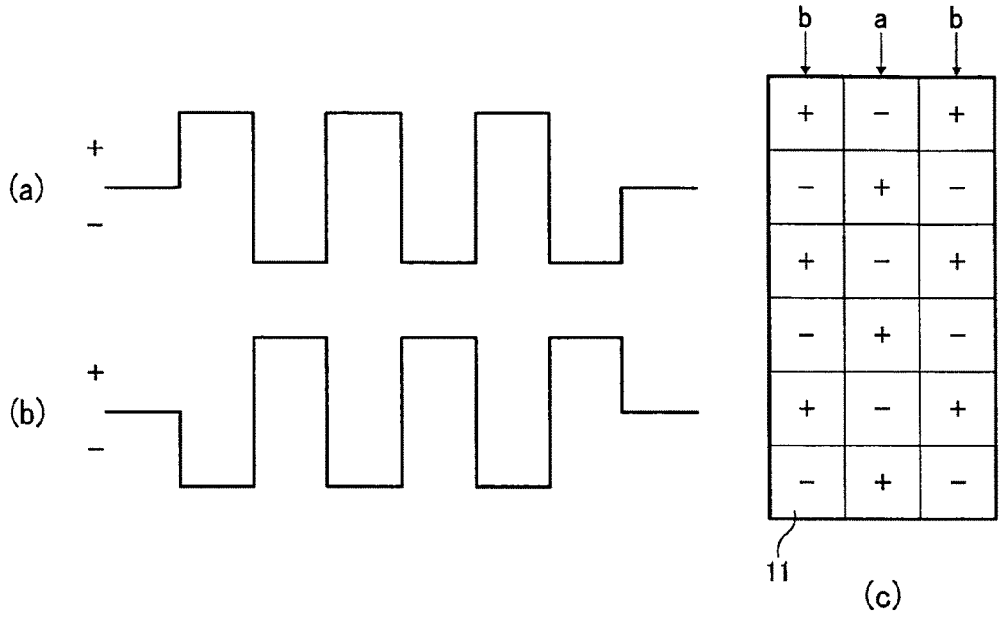
FIG. 5 is a schematic diagram of an example of waveforms of an alternating current voltage output from a power unit, and a charging pattern formed on the conveying belt according to the image forming apparatus of the first embodiment of the present invention.
Figure 6:
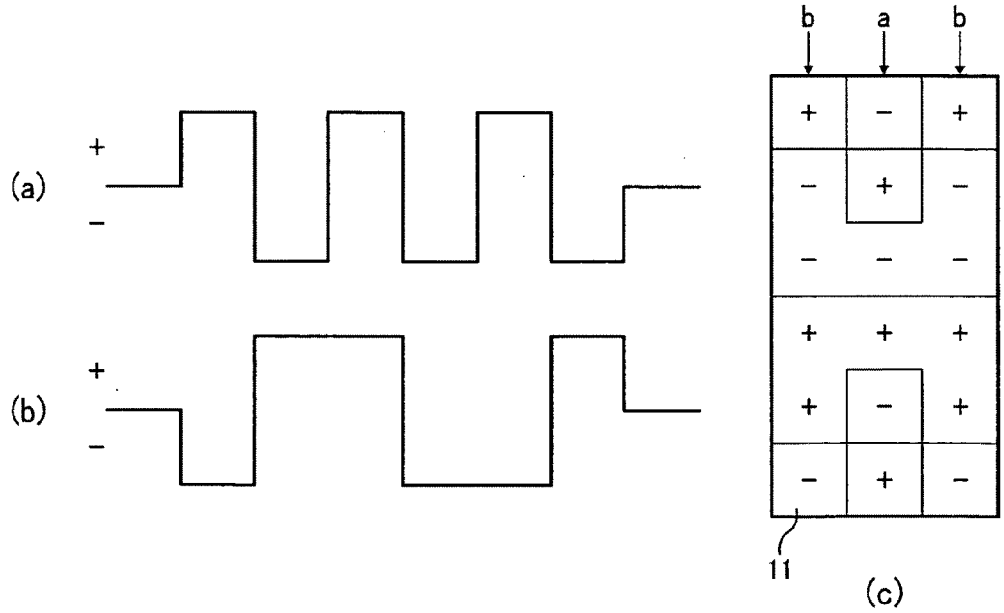
FIG. 6 is a schematic diagram of another example of waveforms of an alternating current voltage output from the power unit, and a charging pattern formed on the conveying belt according to the image forming apparatus of the first embodiment of the present invention.

FIGS. 5 and 6 depict examples of respective waveforms of AC voltages output from the power unit 18*a* and the power unit 18*b*, and charge patterns formed on the conveying belt 11, in the third embodiment.

As in (c) in FIG. 5, the same charge pattern as that in FIG. 4 is formed by applying AC voltages of respective waveforms in (a) and (b) from the power unit 18*a* and the power unit 18*b*, respectively, to the conveying belt 11. Charge patterns formed by the short rollers of the charging rollers 17*a* and 17*b* are denoted by a and b in (c) in FIG. 5, respectively. It is assumed that the conveying belt 11 is conveyed downward in the figure.

According to FIG. 6, a charge pattern in (c) is formed by applying AC voltages of respective waveforms in (a) and (b) from the power unit 18*a* and the power unit 18*b*, respectively, to the conveying belt 11. In this way, as a charge cycle is variable, various charging control become available and an arbitrary charge pattern can be formed, when it is desired to reduce the adsorption force from a default setting, for example, due to environmental influence, or when there is no printing area on the leading end or the trailing end, and it is desired to increase the adsorption force only in such margin area.

Figure 7:
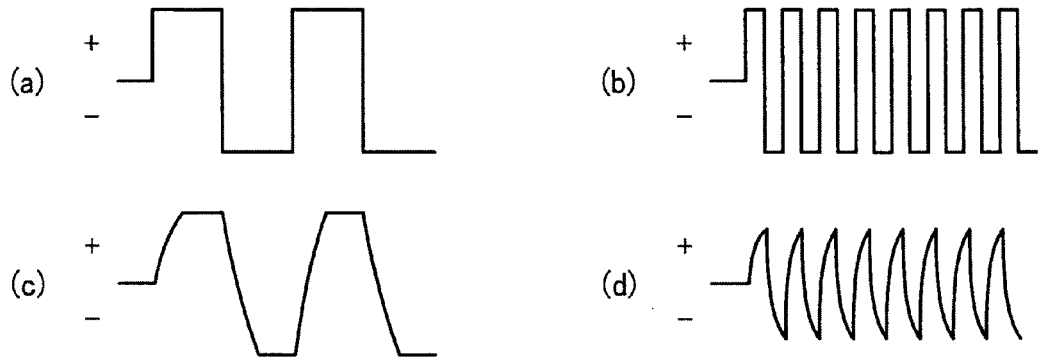
FIG. 7 is a schematic diagram of ideal waveforms and actual waveforms in a case of a long cycle of a power-source voltage and a case of a short cycle of the power-source voltage.

Increase in the number of alternations of the charge polarity (shortening the charge pitch) to enhance the adsorption force without increasing an applied voltage is considered below. If the number of alternations of the charge polarity is increased by shortening the cycle of an applied voltage, there is a problem. First of all, a certain charge-cycle length is required because voltage charge at a high frequency is difficult due to a problem of the trough rate of a power source. Moreover, a time delay occurs at a switching part for switching the polarity in an actual power source. Furthermore, there is another problem that, if shortening the cycle in order to narrow the charge pitch, characteristics of the power source cannot follow a required frequency, and the power source cannot output an assumed peak voltage sufficiently. FIG. 7 depicts such situations. (a) and (b) depict ideal waveforms, and (c) and (d) depict actual waveforms, in a case of a long cycle and a case of a short cycle, respectively.

Figure 8:
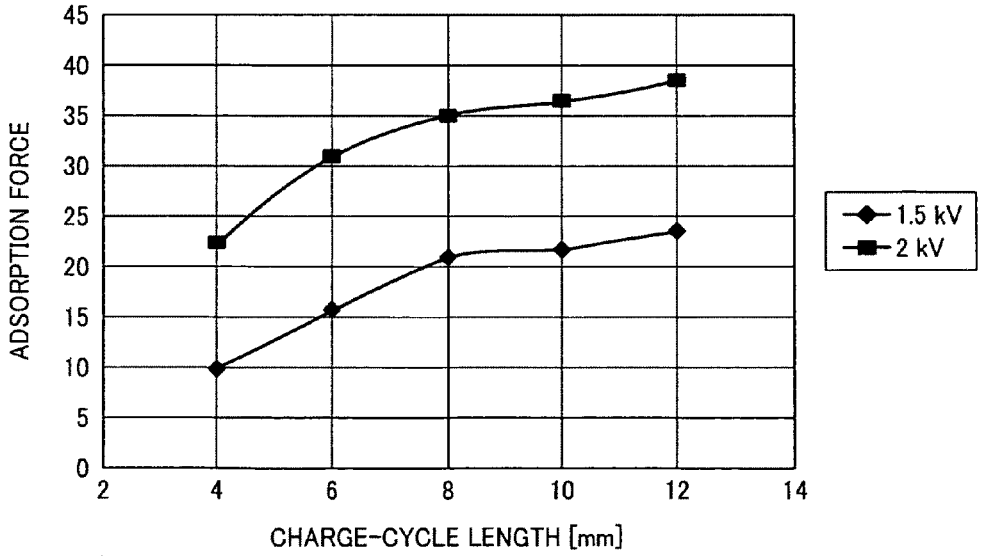
FIG. 8 is a graph of a result of an experiment in relation between a charge-cycle length and an adsorption force according to a conventional apparatus.

FIG. 8 is a graph of a result of an experiment in relation between a charge-cycle length and an adsorption force according to the conventional apparatus. As shown in the figure, it has been found that the highest adsorption force is obtained with an applied voltage of ±2 kilovolts [kV] at a charge-cycle length around 10 millimeters [mm] or longer. However, as described above, because of the problem of the through rate of the power source, as the charge-cycle length becomes shorter, the adsorption force is decreased.

By contrast, according to the third embodiment, the number of boundaries between positive and negative charge areas can be increased by shortening the pitch (width) of each short roller (for example, by making it to a few millimeters), instead of increasing the frequency of the power source, so that switching of output of the power source is not required, and boundary surfaces can be increased without influence of the through rate.

Figure 9:
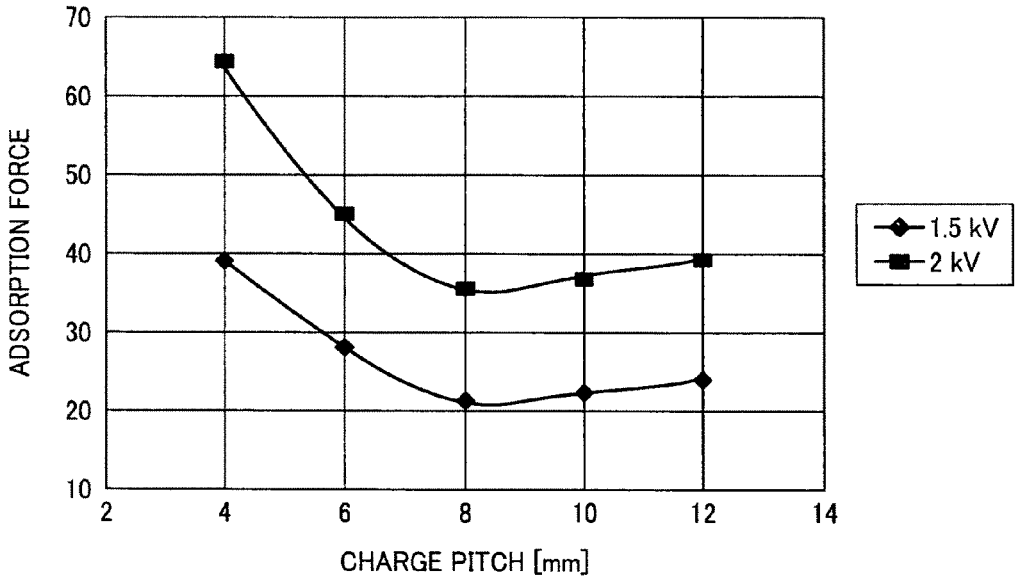
FIG. 9 is a graph of a result of an experiment in relation between a charge pitch and an adsorption force according to each of the embodiments of the present invention.

FIG. 9 is a graph of a result of an experiment in relation between a charging pitch and an adsorption force according to each of the embodiments of the present invention. According to each of the embodiments of the present invention, an ideal adsorption force that is fundamentally required can be obtained even when the charge pitch is narrow, because not depending on characteristics of the power source. The graph in the figure is a result calculated by using an electric-field simulator based on a result of an experiment, according to which it is found that an adsorption force obtained by the conventional apparatus with, for example, an applied voltage of 2 kilovolts and a charge-cycle length of 10 millimeters, is obtained with an applied voltage of 1.5 kilovolts and a charge pitch of 4 millimeters of a charging roller. Furthermore, a strong adsorption force can be obtained with a lower voltage according to a combination with charge-cycle length control as shown in FIG. 4.

In this way, according to the third embodiment, because the number of boundaries can be increased without increasing a voltage, a sufficient adsorption force can be obtained by forming an electric field with a smaller peak. Although a charging method by using a charging roller is described in FIG. 4, a charging method by using an electrode according to an electric discharge with needle or a discharge brush is conceivable to narrow the charge pitch.

Figure 10:
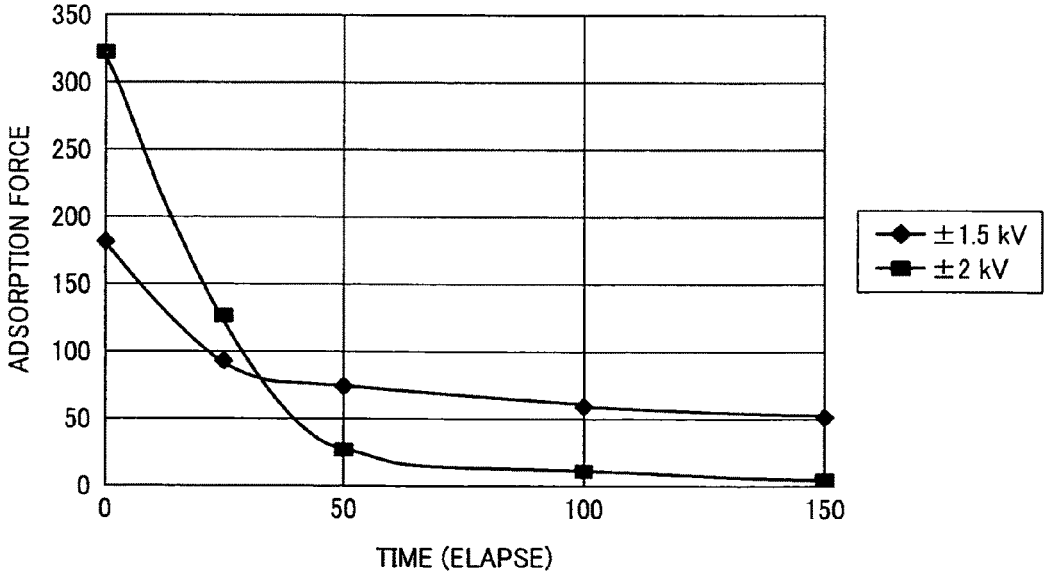
FIG. 10 is a graph of time-sequential change in an adsorption force of a conveying belt.

In an actual use environment, a problem arises from change with time in physical properties of the conveying belt 11. FIG. 10 is a graph of time-sequential change in the adsorption force of the conveying belt 11. As shown in the figure, even if performing the same control, the adsorption force decreases with time. A cause for this is that an intended charge cannot be maintained sufficiently because a substance that decreases the resistance of the conveying belt is deposited on its surface, consequently, an assumed electric field cannot be obtained. The substance that decreases the resistance is a charge deterioration substance (nitrogen oxide), and is observed more markedly at a higher voltage.

Therefore, countermeasures have been taken, such as a mechanism for cleaning the conveying belt 11 (for example, refreshing a surface layer with a cleaning blade), cleaning of the conveying belt performed by a technician, or replacement of the conveying belt as a service part. Although charging control copes with a charge deterioration substance by suppressing a voltage to a low level in accordance with a condition of use, a trouble in paper conveyance sometimes occurs due to an insufficient adsorption force as a side effect. However, according to each of the embodiments of the present invention, the adsorption force can be maintained even if an applied voltage is decreased to a lower level than the conventional apparatus, which can be a countermeasure against the above deterioration with time.

Figure 11:
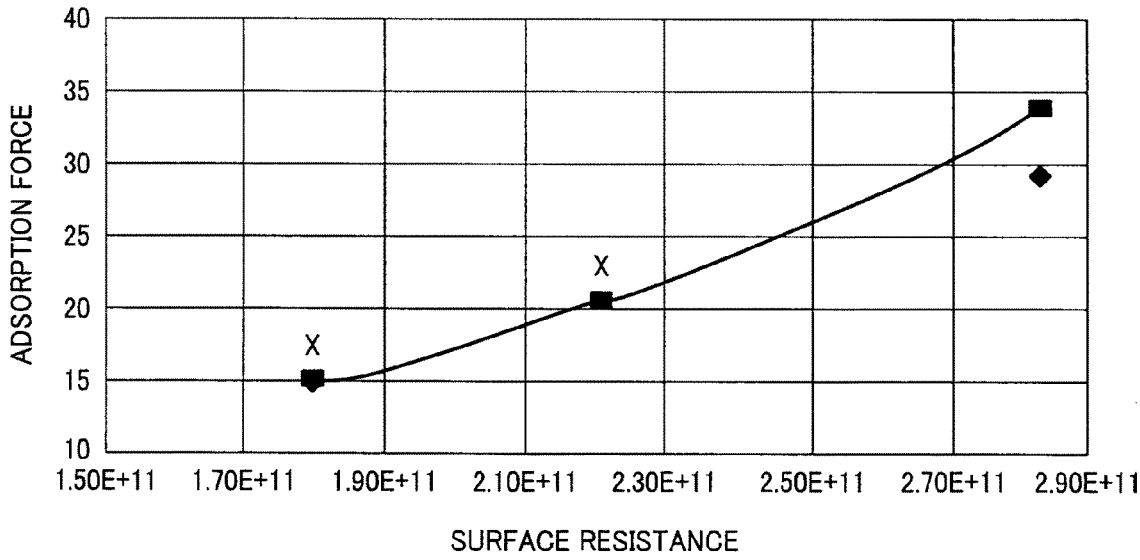
FIG. 11 is a graph that depicts relation between surface resistance of printing paper and an adsorption force.

FIG. 11 is a graph that depicts relation between the resistance of printing paper and an adsorption force. As described above, charging control cannot ignore characteristics of printing paper and influence of a conveying belt, both of which are to be controlled. Because selection of printing paper is made by a user, determination of physical properties of printing paper is meaningful for charging control.

As a known technology, a method of measuring electrical characteristics of paper (for example, the resistance) by bringing a printing area into electrical conduction while conveying printing paper is developed into practical use for some products. According to the third embodiment, optimal charging control is achieved by performing charging control by using such measuring function.

Figure 19:
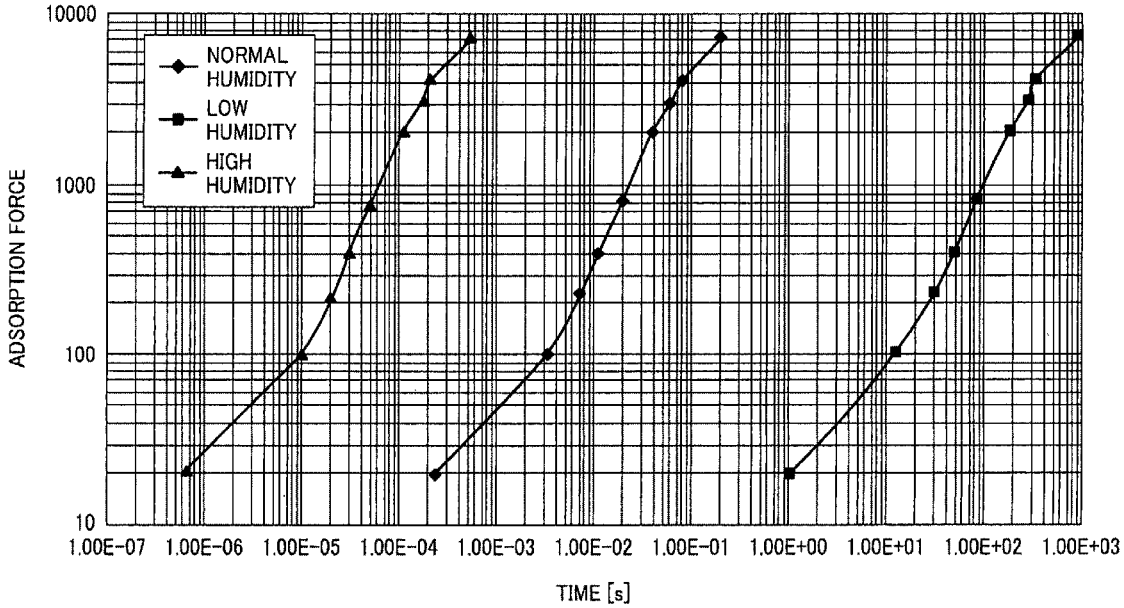
FIG. 19 is a graph of a temporal transition of adsorbability with respect to humidity as a parameter until a certain adsorption force is generated.

Moreover, as a more cost effective method, a method of using an internal environment of the machine as control information is conceivable, instead of measuring electrical characteristics of printing paper. Specifically, an internal temperature and an internal humidity of the machine are measured by using temperature and humidity sensors. As described above with reference to FIG. 19, particularly when a recording medium is paper, because the resistance varies to a large extent and the adsorption force changes depending on a humidity condition, a conveyance trouble occurs more barely, by using a result of the measurement.

Furthermore, as described above with reference to FIG. 10, deterioration of a conveying belt with time is also a factor that is not ignorable. According to the configuration of the third embodiment, it is expected that a lifetime is dramatically extended compared with the conventional apparatus; still it has been experimentally found that charge deterioration substances (nitrogen oxides) are generated not a little, unless a charging voltage is maintained not higher than ±1 kilovolt. Therefore, electrical characteristics (resistance) of the conveying belt are measured, and then feedback is given as control information, so that a conveyance trouble occurs more barely.

However, the charge voltage needs to be increased or the charge pitch in the paper conveying direction needs to be set to 10 millimeters or longer, therefore, occurrence of image abnormality, such as charge irregularity as described above is worried. Therefore, by using a notifying unit that notifies the user of an attention to maintenance, or of apprehension of occurrence of an abnormal image, a product configuration can satisfy a desire of the user.

Figure 12:
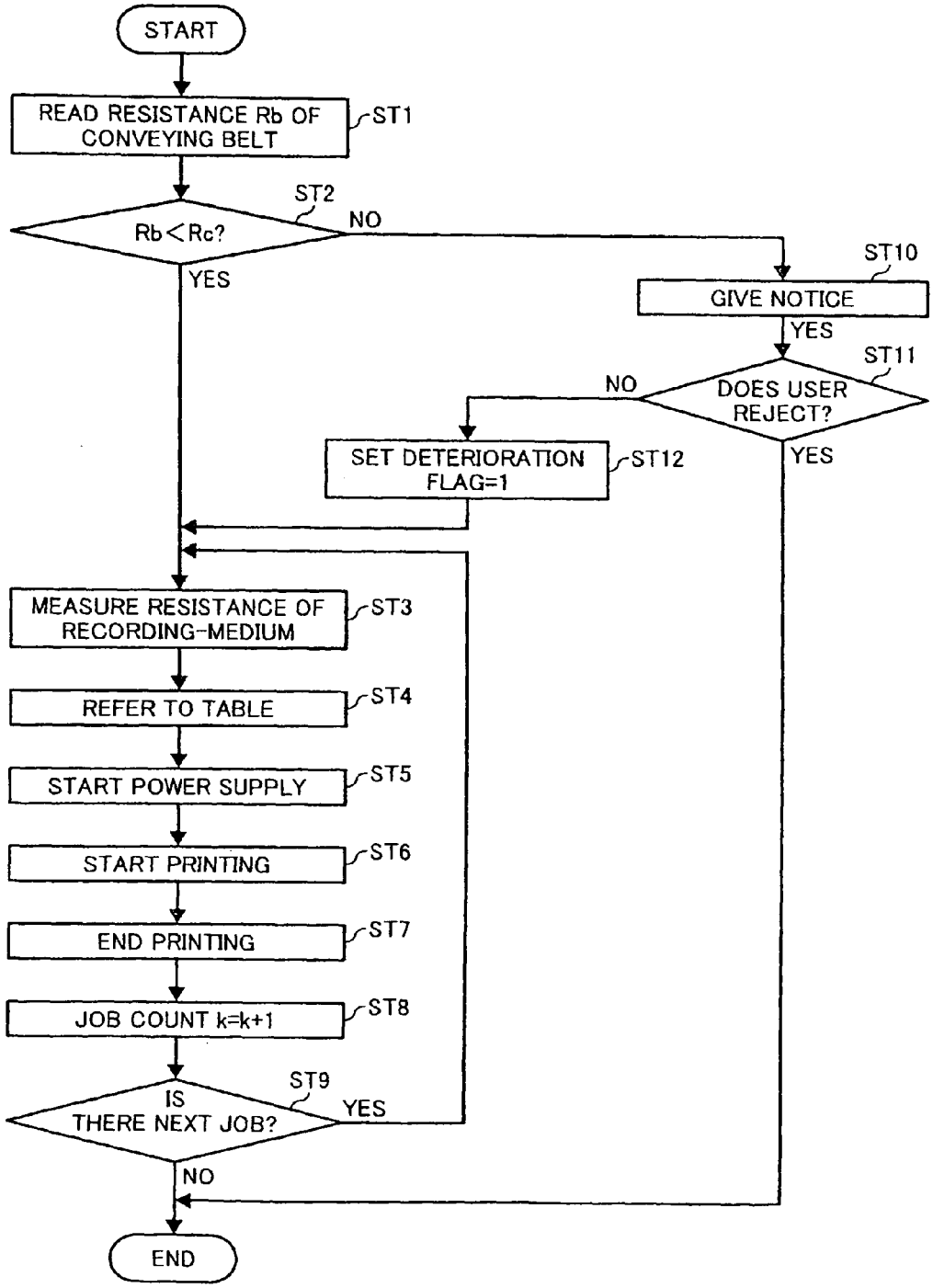
FIG. 12 is a flowchart of an execution of a printing job and charging control according to the image forming apparatus of each of the embodiments of the present invention.

FIG. 12 is a flowchart of an execution of a printing job and charging control according to the image forming apparatus of each of the embodiments of the present invention.

To begin with, the resistance Rb of the conveying belt 11 is read from a memory (the RAM 203) (Step ST1), and then Rb is compared with a threshold Rc (Step ST2); if Rb is larger than the threshold Rc (Yes at Step ST2), the process control goes to Step ST3.

At Step ST3, by operating a not-shown paper feeding motor, a recording medium (the printing paper 19) is conveyed from the paper feeding tray 35 to a registration unit and put on standby, and then the resistance of the recording medium is measured by the surface resistance meter 80. Then at Step ST4, a charge voltage, a charge pitch, a polarity, and a charge-cycle length all of which are preliminarily determined so as to be optimal are acquired by referring to a table in the ROM 202 based on the resistance of the recording medium. If a belt deterioration flag, which will be explained later, is set, a table that considers deterioration of the conveying belt and is different from a usual table is referred.

Then, charging control is executed based on data acquired from the table (Step ST5); the conveying belt 11 is revolved while forming thereon a charge pattern, the recording medium on standby in the registration unit is conveyed with timing of reaching a printing area, and then printing is started (Step ST6).

At Step ST7, printing is finished; and a job counter is incremented at Step ST8. If there is a next printing job (Yes at Step ST9), the process control repeats the processing from Step ST3 for the next printing job.

If the resistance Rb of the conveying belt 11 is smaller than the threshold Rc (No at Step ST2), a notice that prompts to perform maintenance is displayed at the operation panel 217 (Step ST10). When the notice is given, it is additionally notified that printing can be performed without maintenance, and there is a possibility of occurrence of bad quality of image.

If the user gives an instruction of executing printing from the operation panel 217 even though there is a possibility of occurrence of bad quality of image (No at Step ST11), the process control goes to Step ST3 while keeping a state of the belt deterioration flag set at Step ST12.

If the user determines that bad quality of image is the matter, and gives an instruction to end the printing job from the operation panel 217 (Yes at Step ST11), the printing job is terminated, and execution of a maintenance or a request for a service call is carried out.

Figure 13:
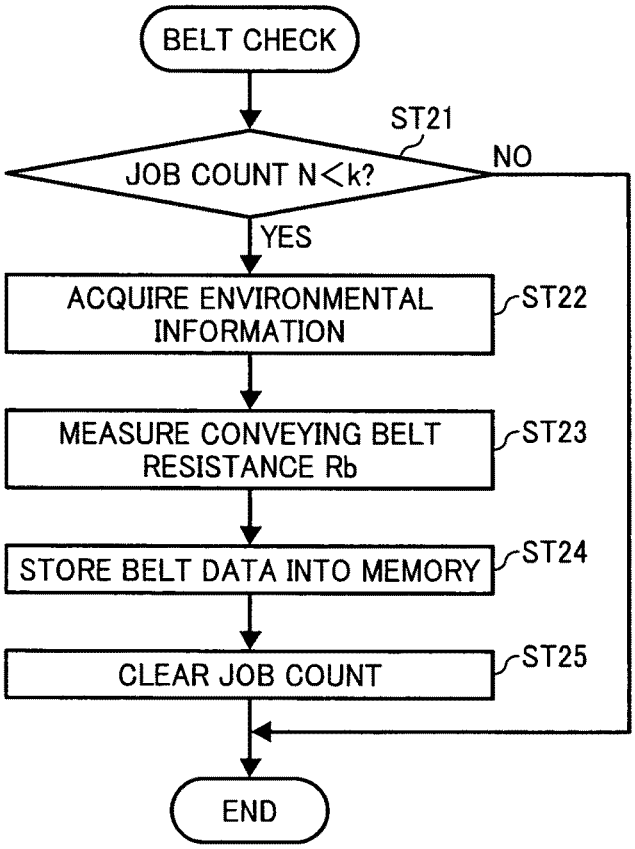
FIG. 13 is a flowchart of control of performing a check on the conveying belt according to the image forming apparatus of each of the embodiments of the present invention.

FIG. 13 is a flowchart of control of performing a check on the conveying belt 11 that can be performed, for example, during initial operation of the image forming apparatus according to each of the embodiments of the present invention.

To begin with, it is determined whether the value of a job count k is larger than a threshold N (Step ST21). If it is determined that it is not larger (No at Step ST21), the control is terminated without performing belt check operation.

By contrast, if it is determined that it is larger (Yes at Step ST21), environmental information about present use environment is read from the environment sensor 218, and stored in the RAM 203 (Step ST22). Then, the surface resistance meter 80 passes a current to the conveying belt 11, and measures the resistance Rb. Based on the environmental information acquired at Step ST22, the value of Rb is corrected (because particularly the humidity affects the resistance).

Then, the corrected value of Rb is stored in the RAM 203 (Step ST24), and then the job counter is cleared (Step ST25), and the processing is terminated.

According to the embodiments of the present invention, a charge pattern in which the polarity alternates in a direction orthogonal to the conveying direction of the conveying belt, i.e., a charge pattern in which straight lines drawn on the conveying belt vertically to the conveying direction and boundary lines between positive and negative charge areas cross one another, is formed at least on positions at which the leading end and the trailing end of a sheet medium are adsorbed. Because an adsorption force becomes the largest on the boundary lines of the positive and negative charge areas, the adsorption force acting on the leading end and the trailing end of the sheet medium is improved.

According to the embodiments of the present invention, when conveying a sheet medium by electrostatically adsorbing it with a charged conveying belt, an adsorption force acting on the leading end and the trailing end of the sheet medium can be improved without increasing the level of a voltage for charging the conveying belt.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet-medium conveying apparatus comprising:

a conveying belt configured to adsorb a sheet medium with an electrostatic force by being electrically charged and convey the sheet medium;

a charge-pattern forming unit configured to form a certain charge pattern on the conveying belt, wherein at least on positions to which a leading end and a trailing end of the sheet medium are to be adsorbed, the charge-pattern forming unit forms a charge pattern in which a polarity changes in a direction orthogonal to a conveying direction of the conveying belt;

a measuring unit configured to measure an electrical characteristic of a sheet medium; and a setting unit configured to set an output voltage of the charge-pattern forming unit in accordance with the electrical characteristic measured by the measuring unit, wherein:

an electrical resistance Rb of the conveying belt is compared with a threshold Rc, prior to measuring the electrical characteristic of the sheet medium, if the electrical resistance Rb is greater than the threshold Rc, the measuring unit starts to measure the electrical characteristic of the sheet medium, and if the electrical resistance Rb is smaller than the threshold Rc, a notice of a possibility of occurrence of bad quality image is given for allowing a user to determine whether to continue a print job.

2. The sheet-medium conveying apparatus according to claim 1, wherein a polarity changes also in the conveying direction of the conveying belt in a charge pattern.

3. The sheet-medium conveying apparatus according to claim 1, wherein the charge-pattern forming unit includes a plurality of charge rollers that is arranged in a directional orthogonal to the conveying direction of the conveying belt; and a power unit configured to apply charges of opposite polarity to adjacent charge rollers, wherein each of the charge rollers includes a plurality of short rollers that is arranged at specific intervals in a rotational axis direction, and positions of the short rollers of the adjacent charge rollers are staggered in the rotational axis direction.

4. The sheet-medium conveying apparatus according to claim 3, wherein the power unit includes a plurality of direct-current power units each of which applies a voltage of one polarity to one of the charge rollers.

5. The sheet-medium conveying apparatus according to claim 3, wherein the power unit includes an alternating-current power unit that applies a voltage of a polarity that alternates to the adjacent charge rollers.

6. The sheet-medium conveying apparatus according to claim 5, further comprising:

another measuring unit configured to measure a parameter including at least one of temperature and humidity inside the sheet-medium conveying apparatus wherein the setting unit is further configured to set an output voltage of the alternating-current power unit in accordance with the parameter measured by the other measuring unit.

7. The sheet-medium conveying apparatus according to claim 3, wherein the power unit includes a plurality of alternating-current power units each of which applies to each of the adjacent charge rollers a voltage of polarity that alternates in one of a different phase and a different cycle that is different from other alternating-current power unit.

8. The sheet-medium conveying apparatus according to claim 7, wherein the setting unit is further configured to set an output voltage of each of the alternating-current power units in accordance with the electrical characteristics measured by the measuring unit.

9. The sheet-medium conveying apparatus according to claim 7, further comprising:

another measuring unit configured to measure a parameter including at least one of temperature and humidity inside the sheet-medium conveying apparatus wherein the setting unit is further configured to set an output voltage of each of the alternating-current power units in accordance with the parameter measured by the measuring unit.

10. The sheet-medium conveying apparatus according to claim 1, wherein if the electrical resistance Rb is greater than the threshold Rc, the setting unit sets the output voltage by referring to a usual table in which a charge voltage, a charge pitch, a polarity and a charge-cycle length are preliminarily determined so as to be optimal for the electrical characteristic.

11. The sheet-medium conveying apparatus according to claim 1, wherein if it is determined to continue the print job even after the notice is given, a belt deterioration flag is set, the measuring unit starts to measure the electrical characteristic of the sheet medium, and the setting unit sets the output voltage by referring to another table which is prepared taking account of deterioration of the conveying belt and which is different from a usual table in which a charge voltage, a charge pitch, a polarity and a charge-cycle length are preliminarily determined so as to be optimal for the electrical characteristic.

12. An image forming apparatus comprising:

a sheet-medium conveying apparatus; and a recording head that forms an image on a sheet medium conveyed by the sheet-medium conveying apparatus, wherein the sheet-medium conveying apparatus includes:

a conveying belt configured to adsorb a sheet medium with an electrostatic force by being electrically charged and convey the sheet medium; and a charge-pattern forming unit configured to form a certain charge pattern on the conveying belt, wherein at least on positions to which a leading end and a trailing end of the sheet medium are to be adsorbed, the charge-pattern forming unit forms a charge pattern in which a polarity changes in a direction orthogonal to a conveying direction of the conveying belt;

a measuring unit configured to measure an electrical characteristic of a sheet medium; and a setting unit configured to set an output voltage of the charge-pattern forming unit in accordance with the electrical characteristic measured by the measuring unit, wherein:

an electrical resistance Rb of the conveying belt is compared with a threshold Rc, prior to measuring the electrical characteristic of the sheet medium, if the electrical resistance Rb is greater than the threshold Rc, the measuring unit starts to measure the electrical characteristic of the sheet medium, and if the electrical resistance Rb is smaller than the threshold Rc, a notice of a possibility of occurrence of bad quality image is given for allowing a user to determine whether to continue a print job.

13. The image forming apparatus according to claim 12, wherein a polarity changes also in the conveying direction of the conveying belt in a charge pattern.

14. The image forming apparatus according to claim 12, wherein the charge-pattern forming unit includes a plurality of charge rollers that is arranged in a directional orthogonal to the conveying direction of the conveying belt; and a power unit configured to apply charges of opposite polarity to adjacent charge rollers, wherein each of the charge rollers includes a plurality of short rollers that is arranged at specific intervals in a rotational axis direction, and positions of the short rollers of the adjacent charge rollers are staggered in the rotational axis direction.

15. The image forming apparatus according to claim 14, wherein the power unit includes a plurality of direct-current power units each of which applies a voltage of one polarity to one of the charge rollers.

16. The image forming apparatus according to claim 14, wherein the power unit includes an alternating-current power unit that applies a voltage of a polarity that alternates to the adjacent charge rollers.

17. The image forming apparatus according to claim 14, wherein the power unit includes a plurality of alternating-current power units each of which applies to each of the adjacent charge rollers a voltage of polarity that alternates in one of a different phase and a different cycle that is different from other alternating-current power unit.

18. The image forming apparatus according to claim 12, wherein if the electrical resistance Rb is greater than the threshold Rc, the setting unit sets the output voltage by referring to a usual table in which a charge voltage, a charge pitch, a polarity and a charge-cycle length are preliminarily determined so as to be optimal for the electrical characteristic.

19. The image forming apparatus according to claim 12, wherein if it is determined to continue the print job even after the notice is given, a belt deterioration flag is set, the measuring unit starts to measure the electrical characteristic of the sheet medium, and the setting unit sets the output voltage by referring to another table which is prepared taking account of deterioration of the conveying belt and which is different from a usual table in which a charge voltage, a charge pitch, a polarity and a charge-cycle length are preliminarily determined so as to be optimal for the electrical characteristic.

* * * * *